US005136959A

United States Patent [19]

Perrone, Jr.

[11] Patent Number: 5,136,959

[45] Date of Patent: Aug. 11, 1992

[54] EMERGENCY MARINE COOLING DEVICE

[75] Inventor: Alexander J. Perrone, Jr., 3005 Fontanar St., Lutz, Fla. 33549

[73] Assignee: Alex J. Perrone, Jr., Lutz, Fla.

[21] Appl. No.: 648,992

[22] Filed: Jan. 31, 1991

[51] Int. Cl.[5] ..... B63H 21/38

[52] U.S. Cl. ..... 440/88

[58] Field of Search ..... 440/88, 113, 500; 114/145 A

[56] References Cited

U.S. PATENT DOCUMENTS

| | | | |
|---|---|---|---|
| 2,355,842 | 8/1944 | Arado | 440/900 |
| 2,984,203 | 5/1961 | Canning | 114/145 A |
| 3,117,548 | 1/1964 | Rasmussen | 114/145 A |
| 3,240,181 | 3/1966 | Chandler et al. | 440/88 X |
| 4,258,642 | 3/1981 | Burmeister | 440/88 X |
| 4,767,366 | 8/1988 | Lang | 440/88 |
| 4,832,639 | 5/1989 | Karls et al. | 440/88 |

*Primary Examiner*—Sherman Basinger

[57] ABSTRACT

An emergency marine cooling device to be stored in a marine vessel and to be installed onto the lower section of a marine engine used for propelling the vessel when the water pump of the marine engine has failed or has a deteriorated output, causing an overheating problem. The apparatus comprises two elongated strips of material and mounting fasteners for attaching the strips together over the lower section of the marine engine. Each of the elongated strips of material is provided with openings and protruding water scoops which are positioned over the water pump intake ports of the engine wherein cooling water is directed under the pressure created by forward motion of the engine into the intake ports providing for temporary repair to the engine. The engine then can be used to propel the vessel to safety.

1 Claim, 1 Drawing Sheet

EMERGENCY MARINE COOLING DEVICE

BACKGROUND OF THE INVENTION:

1. Field of the Invention and Brief Summary

The invention relates to the water cooling of a marine propulsion system.

This invention may be used when an over-heating of the engine due to degradation or failure of the water pump occurs and is detected at the onset, before the propulsion system is completely disabled. This invention can be conveniently attached without tools and will cool or assist the cooling of the marine propulsion system when the propulsion system is in a forward motion, whether the degradation occurs at low RPM in rough seas, or a complete pump failure at any RPM.

2. Prior Art

Previous water force or inducted cooling assisting devices relate to a permanent type or permanent modification to a marine propulsion system for the purpose of increasing or maintaining water flow to a fully functional water pump, when propulsion system is used in a modified or, adverse way, or condition. See for example, U.S. Pat. No. 4,767,366, and U.S. Pat. No. 4,752,257.

Obvious reasons why marine propulsion system manufacturers do not incorporate water pick up ports similar to that of the instant invention are:

A. Unwanted excess drag.

B. Possible trash and debris pickup points could be created on vital part of the cooling system.

C. A non impaired water pump is fully capable of supplying enough water to the cooling system to maintain proper engine temperature.

SUMMARY OF THE INVENTION

Accordingly, it is an object of this invention to provide a new and improved apparatus for continued cooling of an outboard engine, in those cases where the original water pump has become inoperable, or impaired to the point of creating an overheating condition to the engine.

Another object of this invention is to provide an apparatus, which can be stored in the vessel until needed, and, when required, be quickly and easily attached onto the engine in an overheating condition.

Another object of this invention is to provide an apparatus which will increase the safety of the occupants of a vessel and the equipment in the vessel, by providing means for continued operation of the engine after an overheating condition of the engine is encountered due to the failure of the engines water cooling system.

In carrying out this invention in the illustrative embodiment thereof, two elongated strips of material are attached onto the lower section of the engine, at the point of entry of the cooling water to the engines water pump. These two elogated strips of material have a plurality of holes, thereby providing means for attaching the two strips of material together and onto marine engines of various sizes, one strip on each side of the lower section of the engine.

Now, these two elongated strips of material are provided with a scoop like, protrusion in their center section, such scoop like protrusions being a part of an opening in the central region of the strips of material, and, this opening in the elongated strip of material being positioned over the entrance to the water pump compartment, one strip of material on each side of the engine, in a position to engage and seal around the water intake port of the engine, and, are affixed thereto, wherein the forward movement of the engine providing means for water flow, now under pressure created by the forward movement of th engine, to be forced into the compartment of the engine housing the water pump, thereby providing means for the water, now under a certain pressure, to enter into the cooling system of the engine, thereby providing means for cooling the engine after the original water pump has either stopped working, or, has a deteriorated output to the engine, thusly creating the overheating condition.

Conveniently, the user of the vessel with the overheat condition, tilts the engine out of the water, grasps the apparatus of this invention, positions the two strips of material with the scoops directly over, and engaging the entrance holes to the water pump compartment of the engine, the entrance of the protrusions having their openings pointed towards the bow of the boat. The two elongated strips of material are now affixed onto the lower section of the engine, using suitable hardware.

The engine can now be re-inserted into the water, re-started, and the user continues on the journey, using this invention as the cooling device for the engine.

BRIEF DESCRIPTION OF THE DRAWINGS

The invention, together with other objects, features, aspects and advantages thereof, will be more clearly understood from the following description, considered in conjunction with the accompanying drawings.

DESCRIPTION OF THE PREFERRED EMBODIMENT

Figure 2:
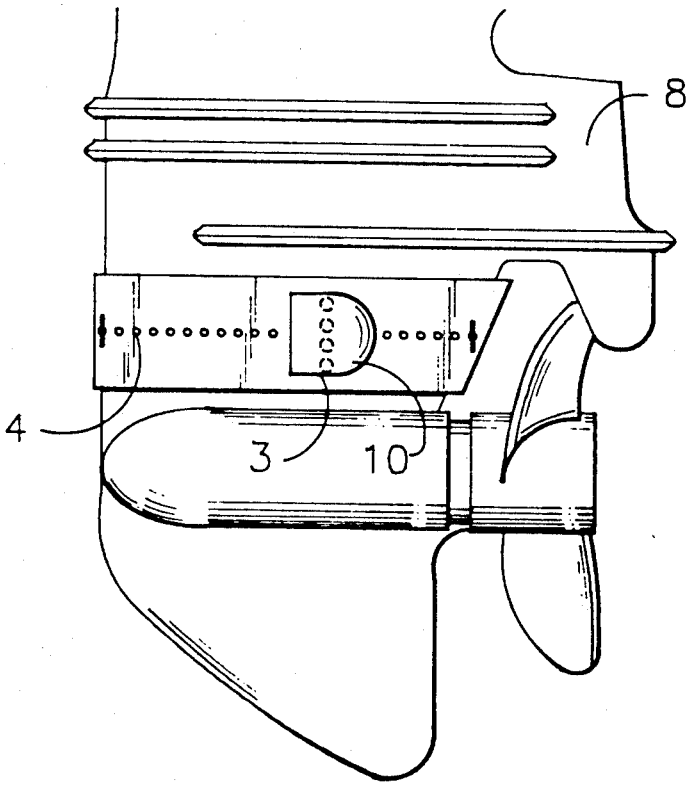
FIG. 2 is a side view of the type of marine propulsion system, with lower unit shown, and the invention affixed, and trimmed.
Figure 3:
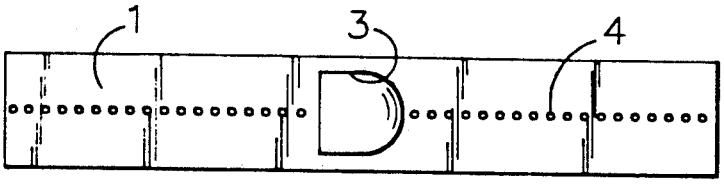
FIG. 3 is a side view of the invention.
Figure 4:
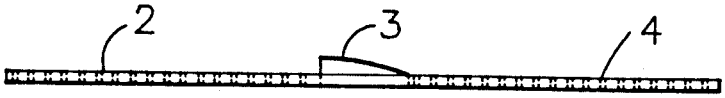
FIG. 4 is a top view of the invention.

Referring to FIG. 4, an emergency marine cooling device, generally referred to as the numeral 1, for the right side of a marine engine, and by the numeral 2, for the left side of a marine engine, are elongated strips of material, having means for mounting onto the lower section of a marine engine 8, seen in FIG. 2,. Still referring to FIG. 4, a series of mounting holes 4, extend a distance from the ends of the elongated strips of material 1, and 2, said distance providing means for mounting onto marine engine of varying sizes.

Referring still to FIG. 4, scoop like protrustion 3, provides means for collecting, and directing water into the water ports 10, of FIG. 2, of the marine engine to be cooled, in FIG. 2, said water being forced into the water ports 10, by the forward motion of the marine engine. The said protrustion 3, with an opening in the elongated strips of material 1, and 2, providing means for the collected water to be forced through the elongated strips of material 1, and 2, and on into the water pump cavity of the marine engine.

Figure 1:
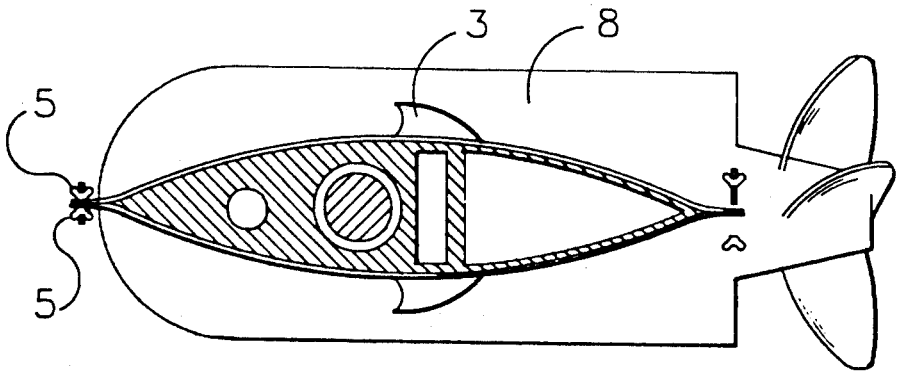
FIG. 1 is a cross section of a marine propulsion system, showing the lower unit, with the invention positioned, prefitted and affixed.

Now, referring to FIG. 1, a suitable bolt and wing nut 5, provides means for affixing the two elongated strips of material 1, and 2, onto the lower section of the marine engine to be cooled, one bolt and wing nut 5, affixing the elongated strips of material 1, and 2, at the front portion of the marine engine 8, and another bolt and wing nut 5, affixing the elongated strips of material 1, and 2, at the rear of the marine engine, said protrusions 3, being directly over the existing water pump intake ports 10, of the marine engine 8.

The excess length of th elongated strips of material 1, and 2, is removed.

Accordingly, a very unique, useful, and convenient method and apparatus are provided for the temporary emergency repair of a marine engine which has overheated, to allow the marine engine to be run at a reasonable speed in order to propel the vessel to safety.

Since minor changes and modifications varied to fit particular operating requirements and environments will be understood by those skilled in the art, the invention is not considered limited to the specific example chosen for purposes of illustration, and includes all changes and modifications which do not constitute a departure from the true spirit and scope of this invention as claimed in the following claims and reasonable equivalents to the claimed elements.

What I claim is:

1. A marine cooling device for repair of a marine engine which has an overheating condition, said marine engine having a lower section with a width extending between a leading edge and a trailing edge and a plurality of cooling water intake ports, said marine cooling device comprising:

two elongated strips of material, each of said strips of material having two ends with the distance between said two ends being substantially greater than said width, each of said strips of material also having at lease two sets of a plurality of holes, each of said sets of said plurality of holes extending inwardly from each of said ends of each of said strips of material so as to provide a central region into which said holes do not extend, said central region having a length less than said width, each of said strips of material further having an opening, said opening being located in said central region of each of said strips of material and being of sufficient size to allow water to enter said water intake ports to cool said marine engine, and a protrusion extending outwardly from each of said openings for collecting and directing water into said openings and into said water intake ports;

suitable hardware for mounting said two elongated strips of material to said marine engine lower section, said suitable hardware cooperating with said holes for mounting said strips of material to said marine engine lower section;

and wherein said strips of material when mounted to said lower section of said marine engine such that said protrusions and said openings cover said water intake ports is able to direct sufficient water flow due to the forward motion of said marine engine into said water intake ports for cooling of said marine engine.

* * * * *